US008043172B2

(12) United States Patent
Campanaro et al.

(10) Patent No.: US 8,043,172 B2
(45) Date of Patent: Oct. 25, 2011

(54) REBOUNDER AND METHOD OF USE

(75) Inventors: Thomas J. Campanaro, Rancho Santa Fe, CA (US); Dan McCutcheon, San Diego, CA (US)

(73) Assignee: Total Gym Global Corp., San Diego, CA (US)

( * ) Notice: Subject to any disclaimer, the term of this patent is extended or adjusted under 35 U.S.C. 154(b) by 91 days.

(21) Appl. No.: 12/556,792

(22) Filed: Sep. 10, 2009

(65) Prior Publication Data

US 2011/0059816 A1 Mar. 10, 2011

(51) Int. Cl.
*A63B 63/00* (2006.01)
*A63B 69/00* (2006.01)

(52) U.S. Cl. ..... 473/435; 273/395

(58) Field of Classification Search ..... 273/395, 273/396; 473/434, 435, 454; 482/27–29
See application file for complete search history.

(56) References Cited

U.S. PATENT DOCUMENTS

| | | | | | |
|---|---|---|---|---|---|
| 2,992,002 | A * | 7/1961 | Bingham, Jr | 273/395 |
| 3,368,814 | A * | 2/1968 | Kolwicz | 273/342 |
| 3,502,330 | A * | 3/1970 | Cheftel | 273/395 |
| RE30,344 | E * | 7/1980 | McNeil | 482/27 |
| 4,239,235 | A * | 12/1980 | Torres | 473/434 |
| 4,284,271 | A * | 8/1981 | Pettit et al. | 482/27 |
| 4,553,751 | A * | 11/1985 | Ketchum | 473/435 |
| 5,007,638 | A * | 4/1991 | Yukl | 473/435 |
| 5,613,922 | A * | 3/1997 | Hsiang | 473/435 |
| 5,833,234 | A * | 11/1998 | Vavala et al. | 473/434 |
| 5,857,679 | A * | 1/1999 | Ringe et al. | 273/395 |
| 7,060,001 | B2 * | 6/2006 | Publicover | 482/27 |
| 7,481,740 | B2 * | 1/2009 | Colling | 482/27 |
| 7,611,443 | B2 * | 11/2009 | Publicover | 482/27 |
| 2003/0060309 | A1 * | 3/2003 | Smith, IV | 473/431 |
| 2004/0121883 | A1 * | 6/2004 | Publicover | 482/29 |
| 2008/0269020 | A1 * | 10/2008 | Alexander | 482/29 |

OTHER PUBLICATIONS

PlyoRebounder Product Sheet, Engineering Fitness International, 2006, 1 page.

* cited by examiner

*Primary Examiner* — Mark Graham
(74) *Attorney, Agent, or Firm* — Stephen C. Beuerle; Procopio Cory Hargreaves & Savitch LLP

(57) ABSTRACT

A rebounder for rebounding a ball includes a base; a frame pivotally connected to the base for adjusting an angle of the frame relative to the base, the frame including a first member having a first maximum dimension and a second member having a second maximum dimension less than the first member, the second member structurally supported by the first member; a rebounding mat; a plurality of springs coupling the rebounding mat to the first member, and wherein the second member is disposed forward of the springs and configured to protect the springs from contact by the ball.

12 Claims, 8 Drawing Sheets

REBOUNDER AND METHOD OF USE

FIELD OF THE INVENTION

The present invention relates to sports ball rebounders.

BACKGROUND OF THE INVENTION

Sports ball rebounders include a rebounding surface and a frame that carries the rebounding surface. A sports ball is thrown by a user at the rebounder and the rebounder returns the sports ball back to the user. A sports ball rebounder can be used for sports and/or exercise training for a wide variety of sports and/or exercising purposes.

SUMMARY OF THE INVENTION

An aspect of the invention involves a rebounder for rebounding a weighted ball such as a medicine ball for exercise purposes. The rebounder includes a base and a frame that is pivotally connected to the base for adjusting an angle of the frame relative to the base. The frame includes a first hoop and a second hoop. A substantially circular rebounding surface is attached to the first hoop via a plurality of springs extending there between. The second hoop has a diameter less than a diameter of the first hoop. The second hoop is supported by the first hoop and extends above the springs. The base includes studs for receiving annular weights. Adding weights over the studs of the base helps to secure the base to a surface to prevent the rebounder from moving relative to the surface when the weighted ball is rebounded by the rebounder.

Another aspect of the invention involves a rebounder for rebounding a medicine ball. The rebounder includes a base; a frame pivotally connected to the base for adjusting an angle of the frame relative to the base, the frame including a first member having a first maximum dimension and a second member having a second maximum dimension less than the first member, the second member structurally supported by the first member; a rebounding mat; a plurality of springs coupling the rebounding mat to the first member, and wherein the second member is disposed forward of the springs and configured to protect the springs from contact by the medicine ball.

One or more implementations of the aspect of the invention described immediately above include one or more of the following: the first member is a first hoop having a first diameter and the second member is a second hoop having a second diameter less than the first diameter, the hoop and the rebounding mat defining a first plane, the second hoop defining a second plane parallel to, and forward of, the first plane; the base includes one or more studs configured to receive one or more annular weights to weigh down the base; the first member includes a lower end pivotally coupled to the base and an upper end adjustably securable to the support arm at multiple positions for adjusting the angle of the frame relative to the base; the frame is collapsible on the base and the support arm is positionable beneath the base for at least one of storage and transport of the rebounder; the support arm includes the multiple positions that the upper end is adjustably securable to for adjusting the angle of the frame relative to the base; the multiple positions of the support arm correspond to 5 degree angle increments of the frame relative to the base; the multiple positions of the support arm include 11 positions; the multiple positions include an uppermost position corresponding to a 50 degree angle and a lowermost position corresponding to a zero degree angle; the rebounding mat includes a centered target thereon; the base includes one or more foam rubber grip surfaces; a method of using a rebounder including providing the rebounder, throwing the medicine ball at the rebounder, contacting the second member with the medicine ball, and protecting the springs from contact by the medicine ball; and/or a method of using a rebounder including providing the rebounder, collapsing the frame on the base, positioning the support arm beneath the base for at least one of storage and transport of the rebounder.

It is understood that both the foregoing general description and following detailed description are exemplary and explanatory and are intended to provide further explanation to the invention as claimed. The accompanying drawings are included to provide a further understanding of the invention and are incorporated in and constitute a part of this specification, illustrate several embodiments of the invention and together with the description serve to explain the principles of the invention.

BRIEF DESCRIPTION OF THE DRAWINGS

The accompanying drawings, which are incorporated in and constitute a part of the specification, illustrate embodiments of the invention and, together with the description, serve to explain the objects, advantages, and principles of the invention. In the drawings.

DETAILED DESCRIPTION OF PREFERRED EMBODIMENTS

Figure 1A:
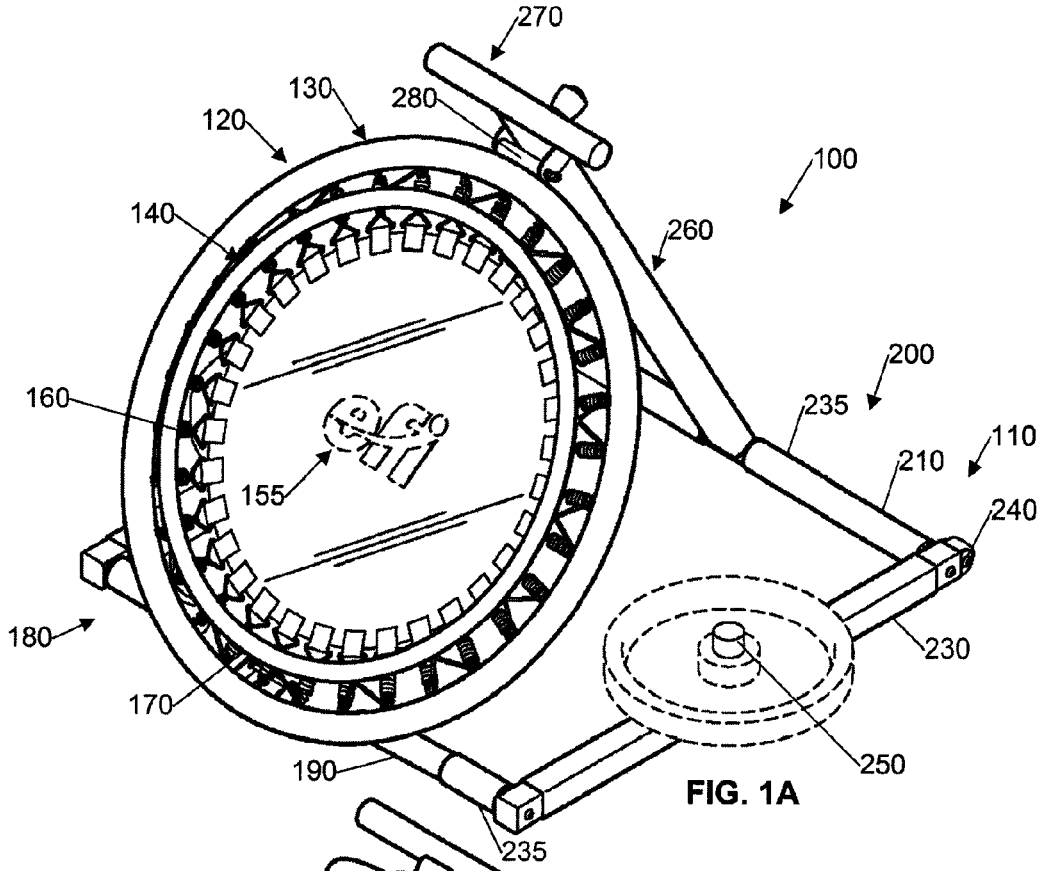
FIGS. 1A-1H are front perspective, rear perspective, front elevational, rear elevational, top plan, right elevational, bottom plan, left elevational views of an embodiment of a rebounder.
Figure 1B:
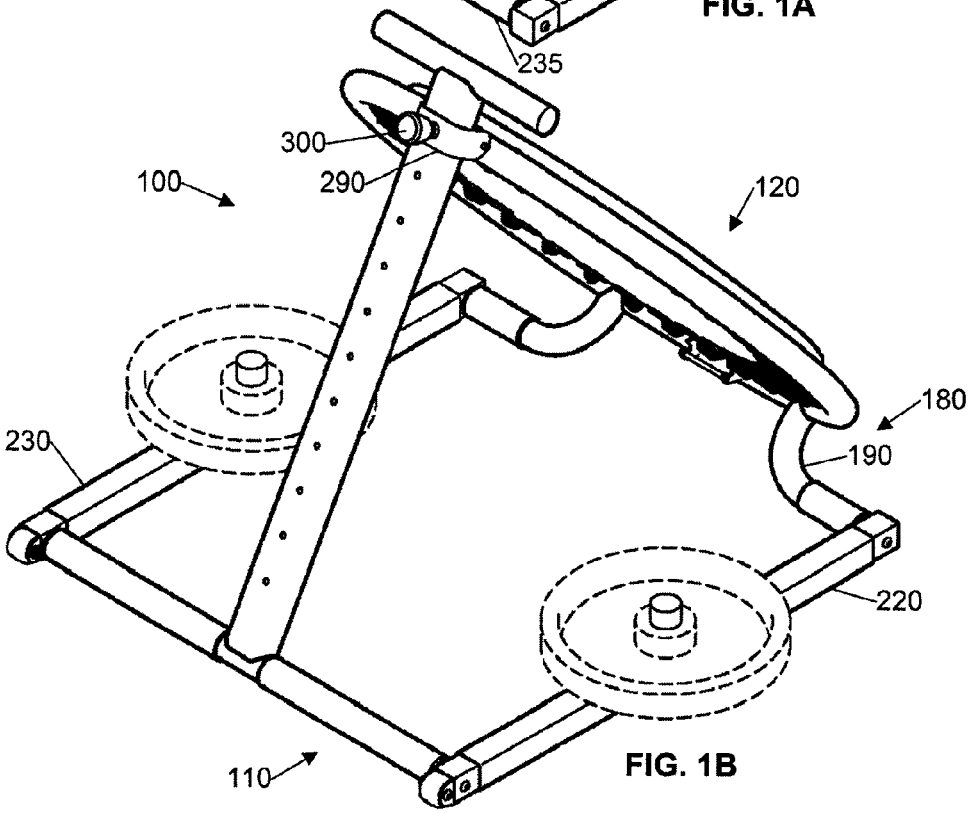
Figure 1C:
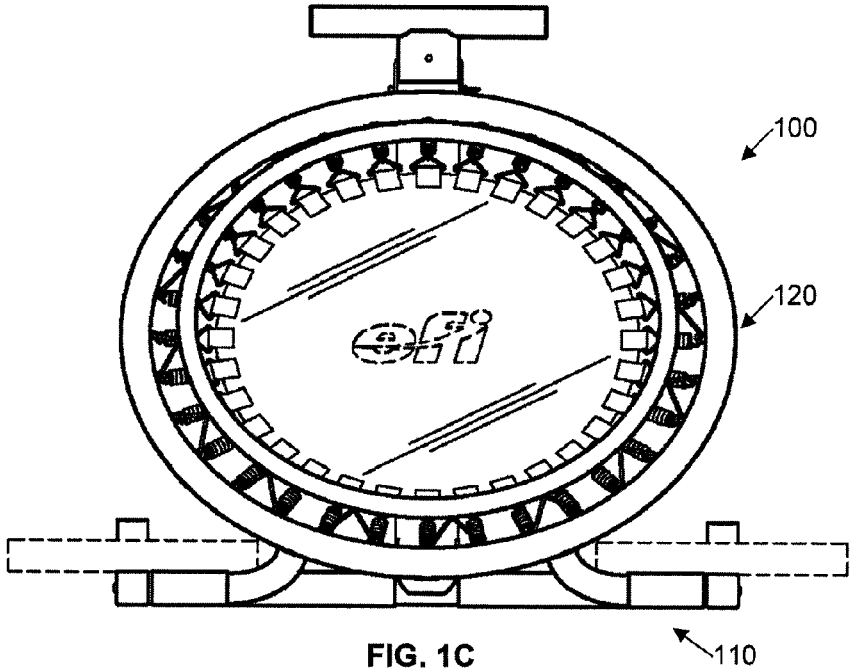
Figure 1D:
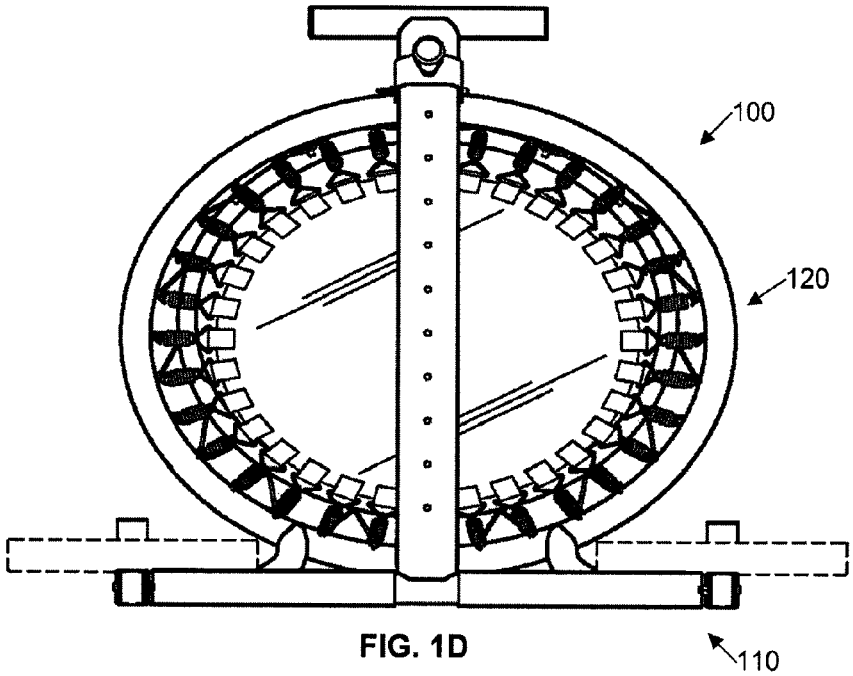
Figure 1E:
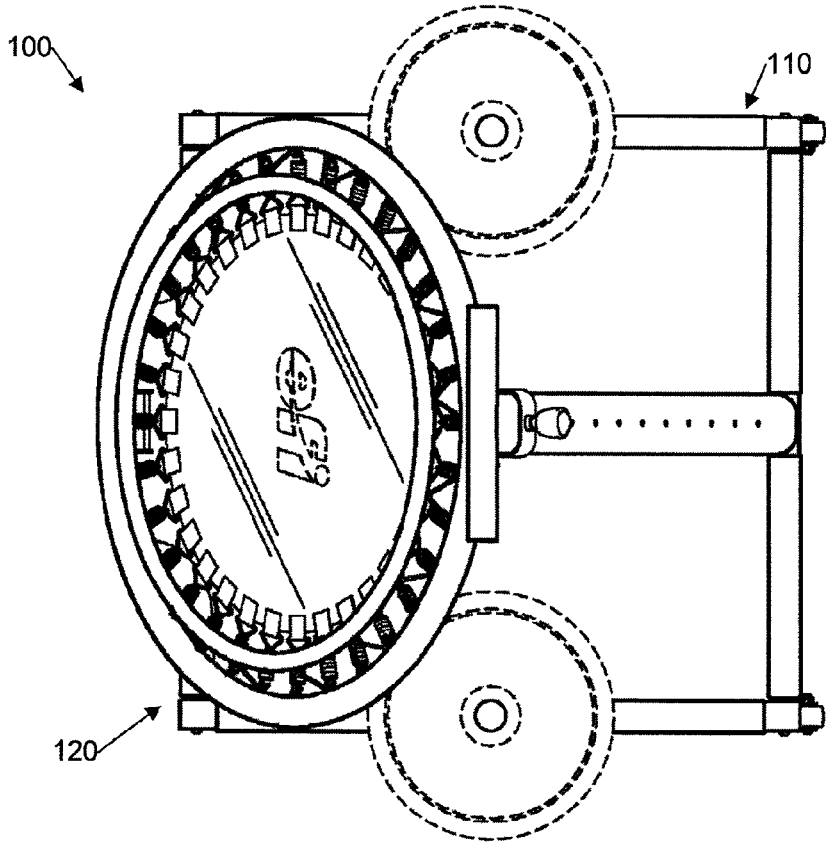
Figure 1F:
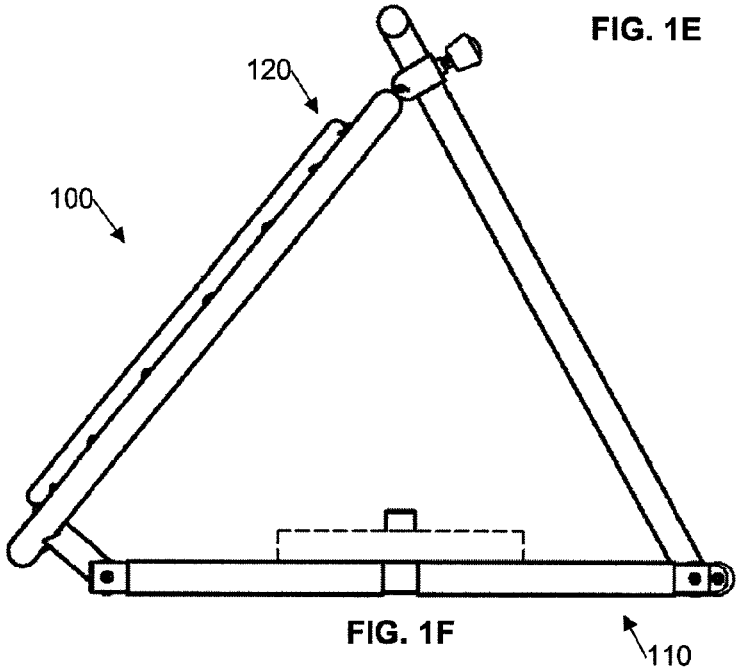
Figure 1G:
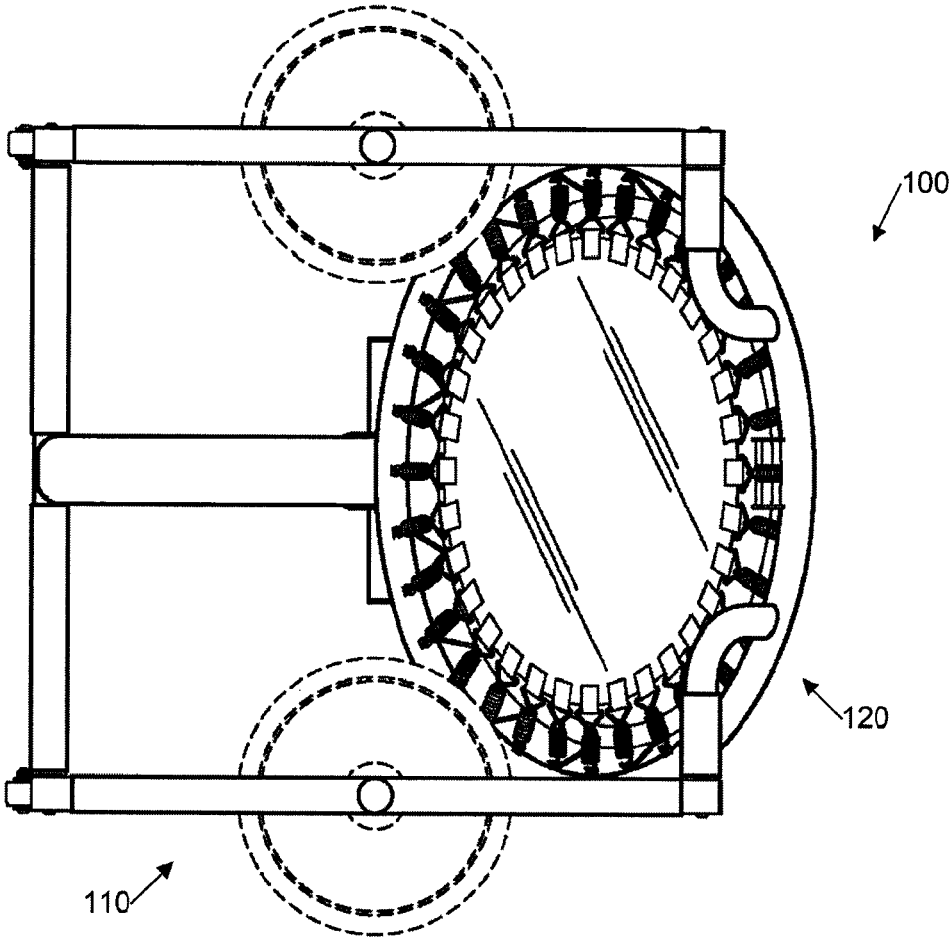
Figure 1H:
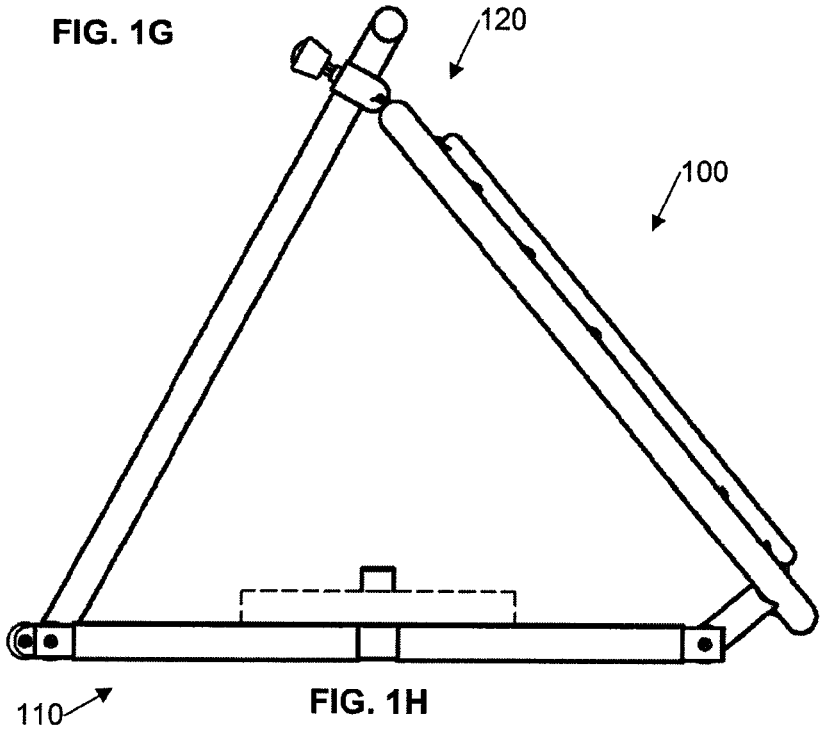

With reference to FIGS. 1A-1G, an embodiment of a rebounder 100 will be described. The rebounder 100 is ideally used with dry-filled, gel-filled, or any other medicine balls of various weights and/or sizes, or regular balls. The medicine ball is thrown by an exerciser against the rebounder 100 and the rebound returns the medicine ball to the exerciser. Each time the exerciser throws the medicine ball (acceleration), the rebounder 100 guides the exerciser to catch the returned medicine ball and follow through with corresponding deceleration. In alternative embodiments the rebounder 100 is used for other rebounding applications that those shown and described herein.

The rebounder 100 includes a base 110 and a frame 120 that is pivotally connected to the base 110 for adjusting an angle of the frame 120 relative to the base 110.

The frame includes a first hoop member ("first hoop") 130 of a first diameter/maximum dimension and a second hoop member ("second hoop") 140 of a second diameter/maximum dimension less than the first diameter of the first hoop 130. In alternative embodiments, the first member 130 and the second member 140 may have configurations other than circular (e.g., hexagonal, octagonal, pentagonal, polygonal).

A flat, substantially circular rebounding surface/mat 150 is attached to the first hoop 130 via a plurality of springs 160 extending there between. The mat 150 may include a target 155 in a center of the mat 150. The target 155 improves the focal point and assists in aiming the medicine ball, and the target 155 allows points for accuracy for game competition and for performance evaluation.

The second hoop 140 is supported by the first hoop 130, extending above, over, and in front of the springs 160 via spoke truss support 170 (the spoke truss construction is only one possible means for providing support for the second hoop 140; plates or other shapes of spokes and attachment point(s) can still offer the bumper benefit and extra strength from the circular truss).

The base 110 includes a front section 180 including opposite curved floor contact tubes 190, a rear section 200 including opposite straight floor contact tubes 210, a left side rail 220, and a right side rail 230. The floor contact tubes 190, 210 include foam rubber grip surfaces 235 thereon to provide the maximum grip to the floor surface to prevent sliding of the base 110 relative to the floor. Opposite terminal ends of the floor contact tubes 190, 210 are pivotally connected to opposite terminal ends of the side rails 220, 230. The rear section 200 includes transport wheels 240 at ends of the side rails 230.

Respective studs 250 extend upwardly from the side rails 220, 230 for receiving annular weights (e.g., Olympic-style weights).

One end of a back handle arm 260 forms a "T" with the opposite straight floor contact tubes 210 and pivots with contact tubes 210. A back handle 270 is disposed at an opposite end of the back handle arm 260.

The rear part of the first loop 130 is adjustably and movably coupled to the back handle arm 260 via a collar pin 280, a clamp collar 290, and a clamp knob 300. A rear of the back handle arm 260 includes position holes 290 for adjustably mounting the claim collar 290 and clamp knob 300 to the back handle arm 260 at a desired location for setting the rebounding surface 150 at a desired angle/incline. The handle arm 260 has a large number of angles/inclines (e.g., from 0 degrees to 50 degrees by 5 degree increments, 11 positions).

To adjust the angle/incline of the frame 120 relative to the base 110, the clamp knob 300 is pulled and/or rotated (untightened) so that clamp collar 290 is no longer secured in a position hole 290, and the clamp collar 290 is moved to the desired location/position hole on the back handle arm 260. The clamp knob 300 may automatically engage each position hole 290 as the clamp collar 290 slides along the back handle arm 260 and/or the clamp knob 300 is rotated (tightened) so that clamp collar 290 is secured in a desired position hole 290 so that the rebounder 100 is at a desired angle/incline.

The first hoop 130 and the rebounding surface 150 define a first plane and the second hoop 140 defines a second plane. The second plane is parallel with the first plane and is disposed above the first plane (closer to the exerciser than the rear section 200). The second hoop 140 extends above, over, and in front of the springs 160 (closer to the exerciser than the rear section 200), protecting the springs 160 from the heavy medicine balls thrown at the rebounder 100. Thus, the second hoop 140 forms a bumper to prevent the medicine ball(s) from hitting and damaging the springs.

In the embodiment shown, each stud 250 for plate weights may receive up to four 45 lb. Olympic-style weights. These weights reduce movement of the rebounder 100 during recoil (when heavy medicine balls (e.g., 12 lbs to 40 lbs) are thrown) with all types of floor surfaces.

Figure 2A:
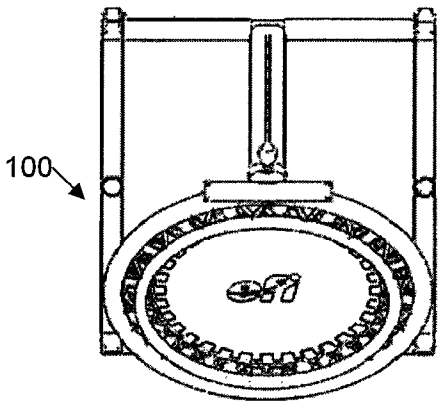
FIGS. 2A-2F are top, front perspective, rear perspective, front elevational, right elevational, and rear elevational views of the rebounder illustrated in FIGS. 1A-1G, and show the rebounder in an angled/inclined condition.
Figure 2B:
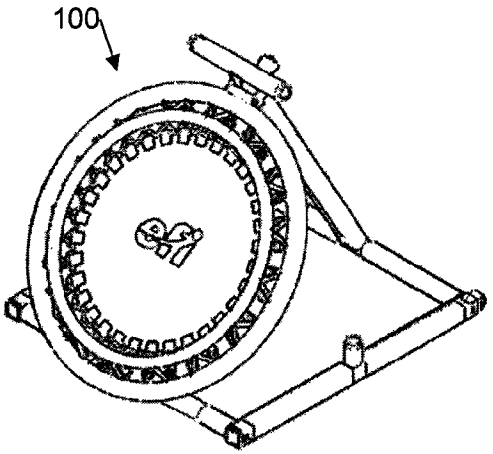
Figure 2C:
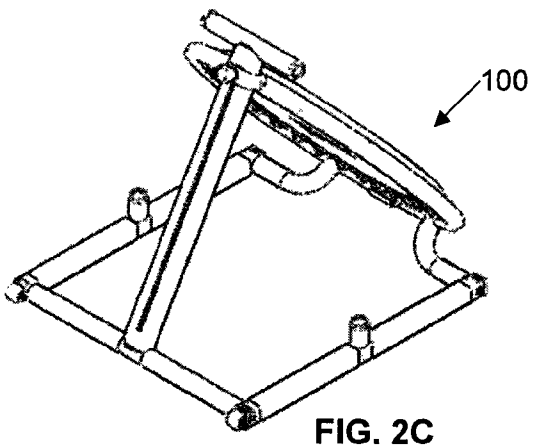
Figure 2D:
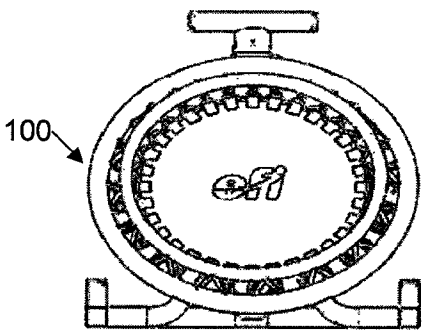
Figure 2E:
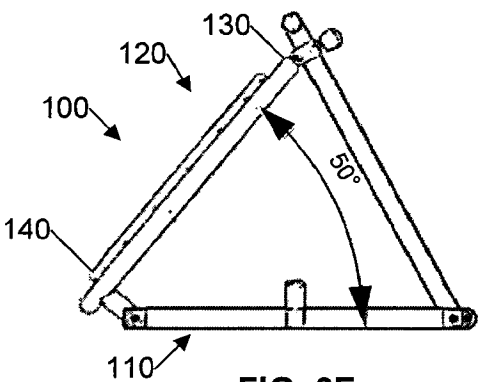
Figure 2F:
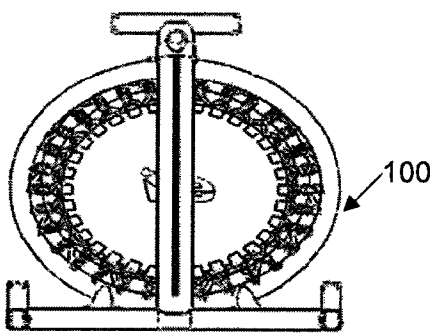

FIGS. 2A-2F show the rebounder 100 in an angled/inclined condition (e.g., highest position, position 11, 50 degree angle/incline).

Figure 3A:
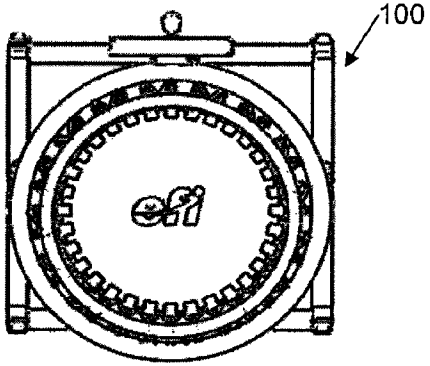
FIGS. 3A-3F are top, front perspective, rear perspective, front elevational, right elevational, and rear elevational views of the rebounder illustrated in FIGS. 1A-1G, and show the rebounder in a lifted condition for transporting the rebounder on transport wheels.
Figure 3B:
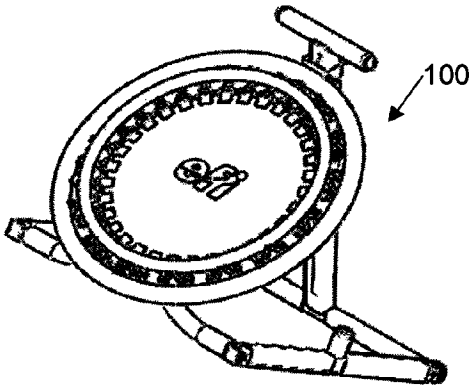
Figure 3C:
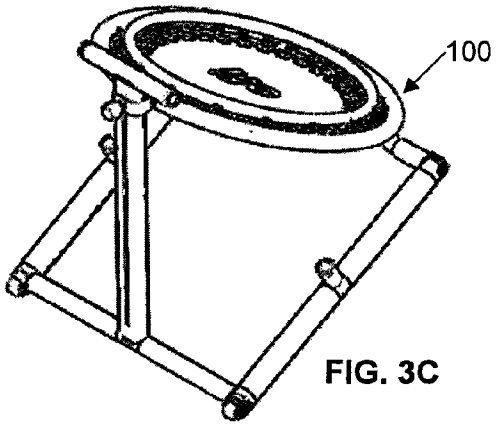
Figure 3D:
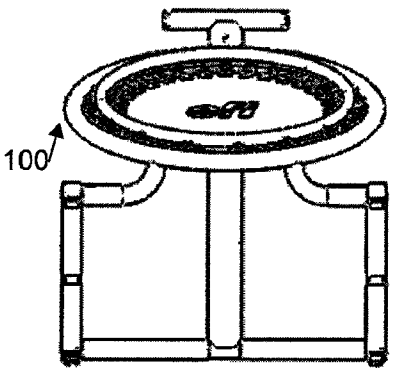
Figure 3E:
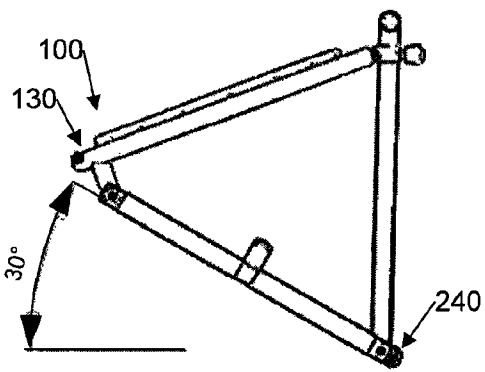
Figure 3F:
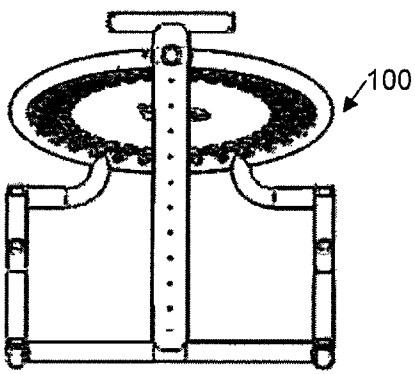

FIGS. 3A-3F show the rebounder 100 in the same angled/inclined condition as FIGS. 2A-2F, and shows how the rebounder 100 may be transported by lifting the rebounder 100 at the bottom of the first hoop 130 so that the rebounder 100 pivots upwardly and is supported by the transport wheels 240. The exerciser may then steer the rebounder 100 and push/pull the wheeled rebounder 100 to a desired location and position.

Figure 4A:
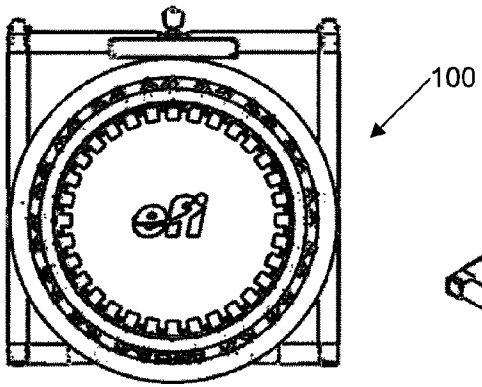
FIGS. 4A-4F are top, front perspective, rear perspective, front elevational, right elevational, and rear elevational views of the rebounder illustrated in FIGS. 1A-1G, and show the rebounder in a horizontal condition for jogging, jumping, and hopping exercise.
Figure 4B:
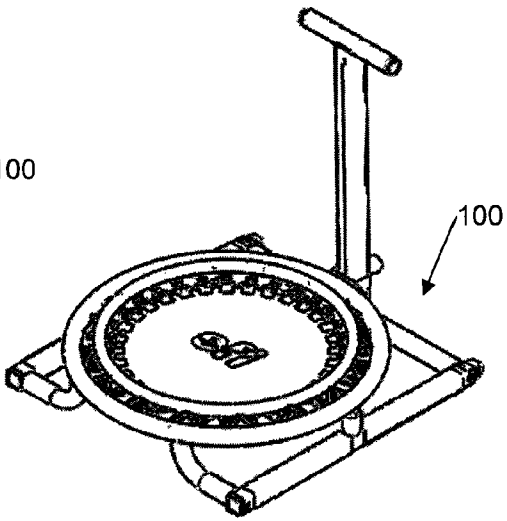
Figure 4C:
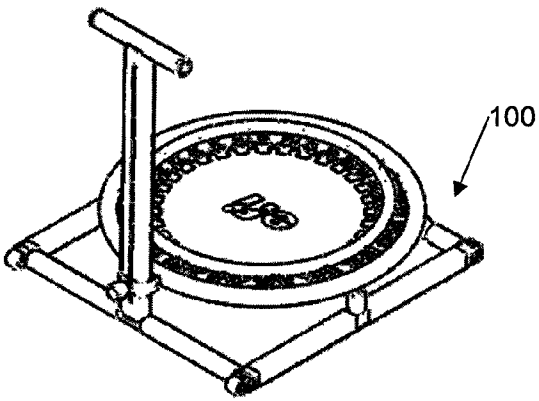
Figure 4D:
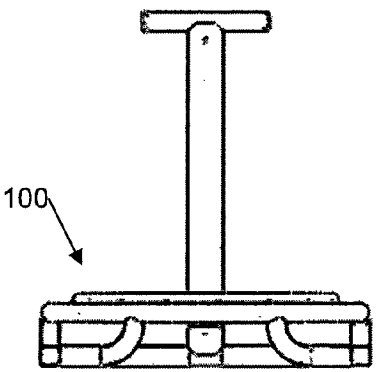
Figure 4E:
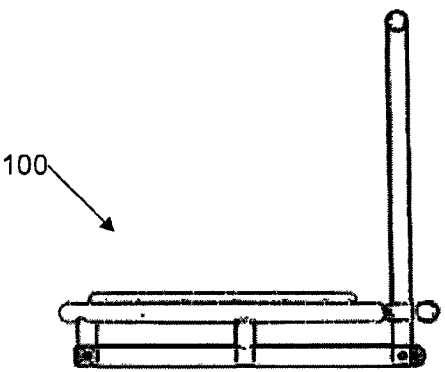
Figure 4F:
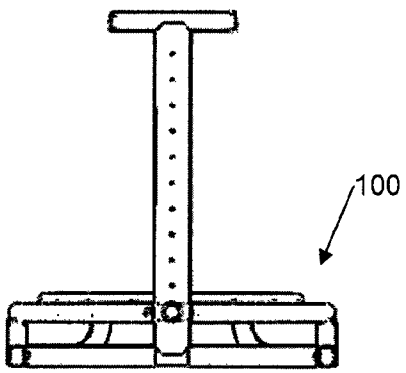

FIGS. 4A-4F show the rebounder in a horizontal or low-compression jogger position for cardiovascular work. Easy on the spine and knees, the uniformly round surface of the mat 150 provides solid support for the feet and ankles during jumping, hopping and jogging exercise.

Figure 5A:
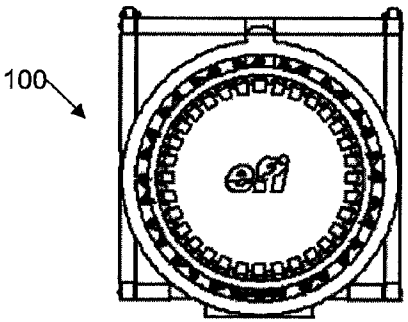
FIGS. 5A-5F are top, front perspective, rear perspective, front elevational, right elevational, and rear elevational views of the rebounder illustrated in FIGS. 1A-1G, and show the rebounder in a horizontal condition with a clamp knob and collar removed from back side and installed on underside of rebounder to lock it for storage and/or shipping.
Figure 5B:
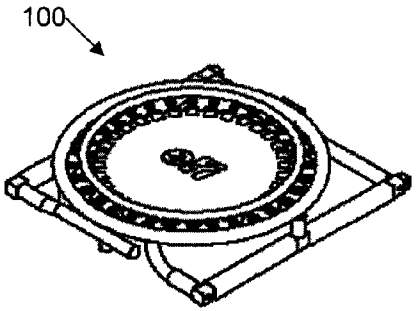
Figure 5C:
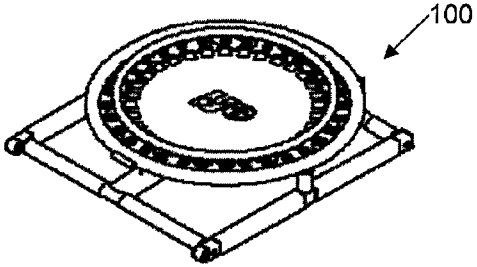
Figure 5E:
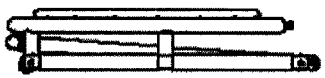
Figure 5F:
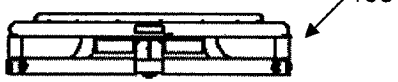
Figure 5D:
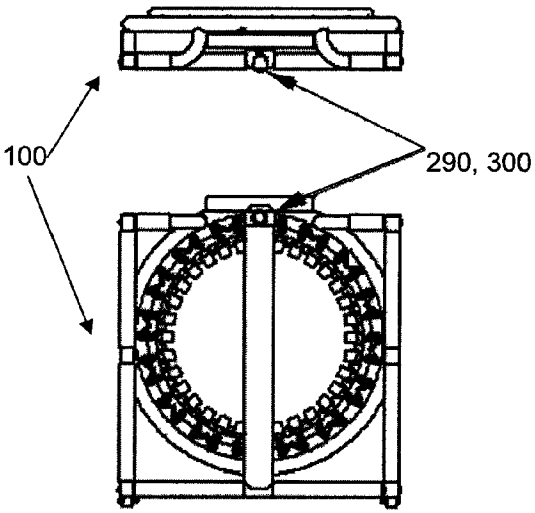

FIGS. 5A-5F show the rebounder 100 in a horizontal condition with the clamp knob 300 and the collar 290 removed from back side and installed on an underside of rebounder 100 to lock it in a compact, flat configuration/position for storage and/or shipping.

Training with the rebounder 100 helps develop core strength, agility and improved reaction time. Exercisers' speed, range of motion and quality of movement improve at every level of function. Regardless of the direction from which the medicine ball (e.g., dry-filled medicine ball) is thrown, the medicine ball returns perpendicular to the rebounding surface 150. Each time the exerciser throws the ball (acceleration), the rebounder 100 guides the exerciser to catch the ball and follow through with corresponding deceleration. In the embodiment shown, the rebounding angle adjusts to eleven levels (e.g., from 0 degrees to 50 degrees by 5 degree increments) to accommodate exercisers of any height, enabling them to exercise from seated, kneeling and standing positions. The rebounder 100 also serves as a low-compression jogger (FIGS. 4A-4G) for cardiovascular work. Easy on the spine and knees, the uniformly round surface of the mat 150 provides solid support for the feet and ankles during jumping, hopping and jogging exercise.

Advantages of the rebounder 100 include the following: strong frame construction enables a strong rebound force and long life; second hoop 140 protects springs 160 from direct impact from heavy medicine balls that could otherwise destroy the springs 160; long life of frame 120 and mat 150 as the impact load from the medicine ball is distributed on a large number of springs; the second hoop 140 causes the exerciser to aim more accurately because there is no rebound from a medicine ball that hits the second hoop 140; the second hoop 140 and spoke construction creates a stronger circular truss than the strength of both rings added together; the studs accommodate weights to reduce movement of the frame 120 and the base 120 relative to the floor surface during recoil; the springs 160 include a thick wire construction and are high-strength springs; the back handle arm has a large number of angles/inclines; at a flat level (FIGS. 4A-4F), the rebounder 100 can still be jumped, hopped, or run on even with weights; foam rubber grip surface 235 around all four floor contact tubes 190, 210 provide the maximum grip to the floor to prevent sliding; the target 155 in center of mat 150 improves the focal point and assists in aiming the medicine ball; and the target 155 allows points for accuracy for game competition and for performance evaluation.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. A rebounder for rebounding a ball, comprising:

a base;

a rebounding mat;

a frame pivotally connected to the base for adjusting an angle of the frame relative to the base, the frame including a first hoop having a first diameter and a second hoop having a second diameter less than the first diameter of the first hoop, the second hoop structurally supported by the first hoop, the first hoop and the rebounding mat defining a first plane, the second hoop defining a second plane parallel to, and forward of, the first plane;

a plurality of springs coupling the rebounding mat to the first hoop, wherein the second hoop is disposed forward of the springs and positioned relative to the first hoop to prevent the ball from passing between the first and second hoops and directly impacting the springs.

2. The rebounder of claim 1, wherein the base includes one or more studs configured to receive one or more annular weights to weigh down the base.

3. The rebounder of claim 1, wherein the rebounding mat includes a centered target thereon.

4. The rebounder of claim 1, wherein the base includes one or more foam rubber grip surfaces.

5. A method of using a rebounder, comprising:

providing the rebounder of claim 1;

throwing the ball at the rebounder;

contacting the second member with the ball, protecting the springs from contact by the ball.

6. A rebounder for rebounding a ball, comprising:

a base;

a frame pivotally connected to the base for adjusting an angle of the frame relative to the base, the frame including a first member having a first maximum dimension and a second member having a second maximum dimension less than the first member, the second member structurally supported by the first member;

a rebounding mat;

a plurality of springs coupling the rebounding mat to the first member; and a support arm, wherein the first member includes a lower end pivotally coupled to the base and an upper end adjustably securable to the support arm at multiple positions for adjusting the angle of the frame relative to the base, and wherein the second member is disposed forward of the springs and configured to protect the springs from contact by the ball.

7. The rebounder of claim 6, wherein the frame is collapsible on the base and the support arm is positionable beneath the base for at least one of storage and transport of the rebounder.

8. The rebounder of claim 6, wherein the support arm includes the multiple positions that the upper end is adjustably securable to for adjusting the angle of the frame relative to the base.

9. The rebounder of claim 8, wherein the multiple positions of the support arm correspond to 5 degree angle increments of the frame relative to the base.

10. The rebounder of claim 8, wherein the multiple positions of the support arm include 11 positions.

11. The rebounder of claim 6, wherein the multiple positions include an uppermost position corresponding to a 50 degree angle and a lowermost position corresponding to a zero degree angle.

12. A method of using a rebounder, comprising:

providing the rebounder of claim 7;

collapsing the frame on the base;

positioning the support arm beneath the base for at least one of storage and transport of the rebounder.

* * * * *